US005160049A

United States Patent [19]

McMillen, Jr.

[11] Patent Number: 5,160,049

[45] Date of Patent: Nov. 3, 1992

[54] TRANSPARENT STAND FOR PIERCED EARRINGS

[76] Inventor: Curtis E. McMillen, Jr., 6302-231st St. SW., Mountlake Terrace, Wash. 98043

[21] Appl. No.: 694,459

[22] Filed: May 1, 1991

[51] Int. Cl.[5] ..... A47F 7/00

[52] U.S. Cl. ..... 211/13; D6/310; D6/469

[58] Field of Search ..... 211/13; 206/495, 6.1; D6/310, 469

[56] References Cited

U.S. PATENT DOCUMENTS

| | | | |
|---|---|---|---|
| D. 228,998 | 11/1973 | Rozman | D6/310 |
| D. 247,825 | 5/1978 | Christianson | D6/469 X |
| D. 252,899 | 9/1979 | Campbell | D6/469 |
| D. 304,533 | 11/1989 | Campbell | D6/310 X |
| 5,033,625 | 7/1991 | Campbell | 211/13 |

*Primary Examiner*—Robert W. Gibson, Jr.
*Attorney, Agent, or Firm*—Christensen, O'Connor, Johnson & Kindness

[57] ABSTRACT

An earring stand (10) is composed of a transparent front panel (14) having a plurality of pair of holes (18) sized for receiving the posts (24) of pierced earrings (20) while not allowing the head or stud portions (22) of the earrings to pass through the holes. A base panel is joined to the bottom of the front panel to support the front panel in upright orientation, with the front panel slopped rearwardly in the upward direction so as to define an arcuate angle (α) between the front and base panels. A top panel (16) extends rearwardly from the upper edge of the front panel, with a plurality of holes formed in the top panel to receive the posts of earrings but not permit the stud portions (22) or the backs (26) of the earrings to pass therethrough.

6 Claims, 4 Drawing Sheets

Fig. 1.
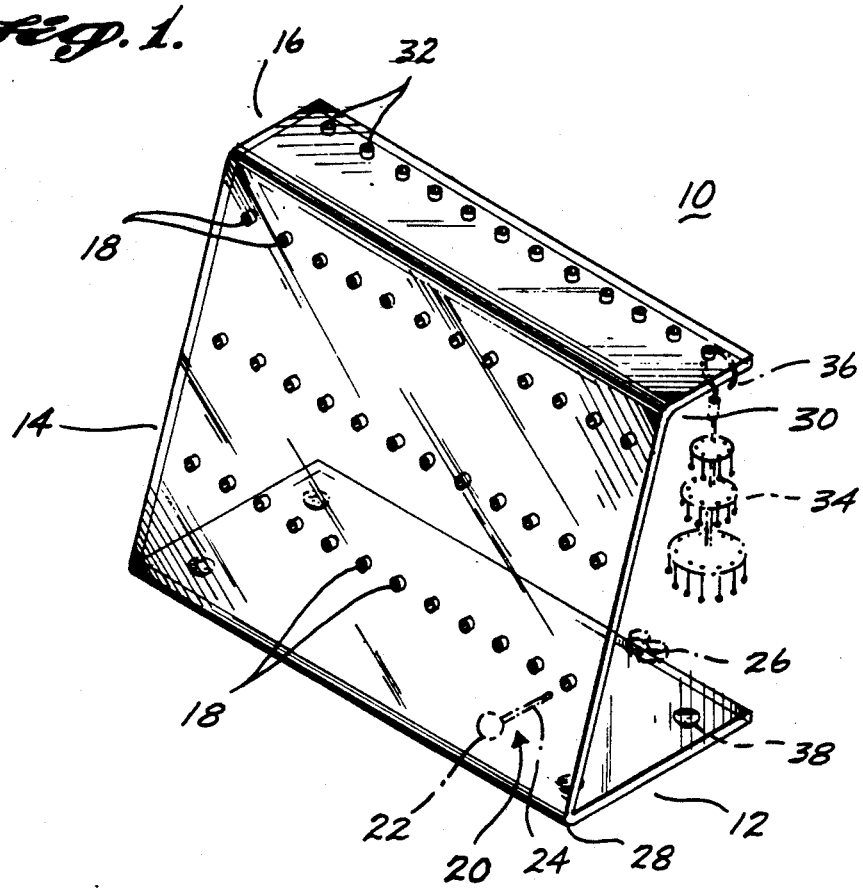
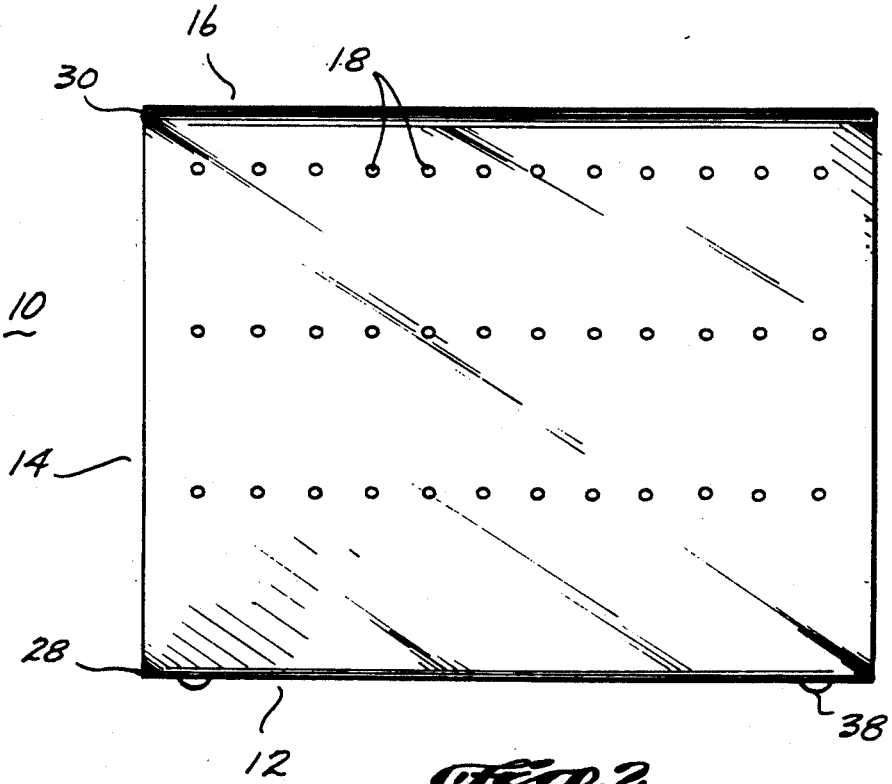
Fig. 2.

TRANSPARENT STAND FOR PIERCED EARRINGS

Field of the Invention

The present invention concerns the storage of earrings, and more particularly a stand for storing and displaying pierced earrings.

Background of the Invention

Pierced earrings usually consist of a stud or other decorative portion worn on the outer side of the earlobe and an attached post which passes through the earlobe. A separate retainer or back typically attaches to the post on the inner side of the earlobe to prevent the earring from accidentally disengaging from the ear.

When not being worn, earrings are typically stored on stands or in holders of different types, shapes, and sizes. In some pierced earring holders, such as a typical jewelry box, the earrings are simply placed loosely in a tray or other compartment. This allows the earring to be stored with the earring back attached. However, as the number of earrings stored in this manner increases, it becomes more difficult to quickly select a pair of earrings or even find both earrings of a selected pair.

Pierced earrings are also stored in a slot or groove formed of soft material which holds the earring post and back. Due to the variations in the size and shape of earring backs, these earring holders do not consistently hold the earrings firmly in the slot or groove. As a result, earrings frequently come out of the slot or groove. Also, the earrings cannot be stored in the vertical orientation in which they will be worn.

In some earring holders, the posts of the earrings are inserted into small holes in the earring holder and the backs are then attached to the posts. In most of these earring holders, the holes are relatively close to an edge of the holder so the user can readily attach the earring back to the post. As a result, the number of earrings these holders can store is generally limited by the perimeter of the edges of the holder.

In addition to the above limitations, in the storage of the earrings most earring holders do not allow the user to select a pair of earrings while viewing the earrings from roughly the same vertical angle that the earring will be viewed when worn. Even those earring stands or holders which do present the earrings in a generally vertical orientation normally cannot be readily manufactured in a wide range of vertical orientations to accommodate the angle from which the user views the stand.

Summary of the Invention

The present invention addresses the drawbacks of existing pierced earring holders by providing an earring stand which allows numerous pairs of earrings to be stored with their backs attached. The earrings are securely mounted on the stand and yet easily removed from the stand. Also, the user can conveniently view the earrings on the stand at a vertical angle roughly equivalent to the angle at which the earring will be viewed when worn.

The present invention provides a stand for holding pierced earrings made of one sheet of transparent or semi-transparent material. The sheet of material is bent parallel to one of its edges at an acute angle to form a base panel, upon which the unit may rest, and a front panel. The front panel sheet of material is bent again, parallel to the original bend, to form a top panel generally parallel to the base panel. Appropriately sized holes are formed in the front panel and top panel so that the posts of pierced earrings may be inserted into the holes without allowing the studs of the pierced earring to pass through the holes.

Since the front and top panels are transparent or at least semi-transparent, the backs of the earrings may easily be engaged over the posts of the earrings after the posts are inserted into the holes in the front and top panels. This allows the earrings to be easily attached to the stand so they will not fall out. In addition, the earrings on the front panel are presented at an angle approximately equal to the angle from which they will be viewed when worn.

Brief Description of the Drawings

The present invention will be described in greater detail, by way of example, with reference to the accompanying drawings, in which:

FIG. 1 is an isometric view of an earring stand constructed in accordance with the present invention as viewed from the front and side of the stand;

FIG. 2 is a front view of the earring stand shown in FIG. 1;

Detailed Description of the Preferred Embodiment

Figure 4:
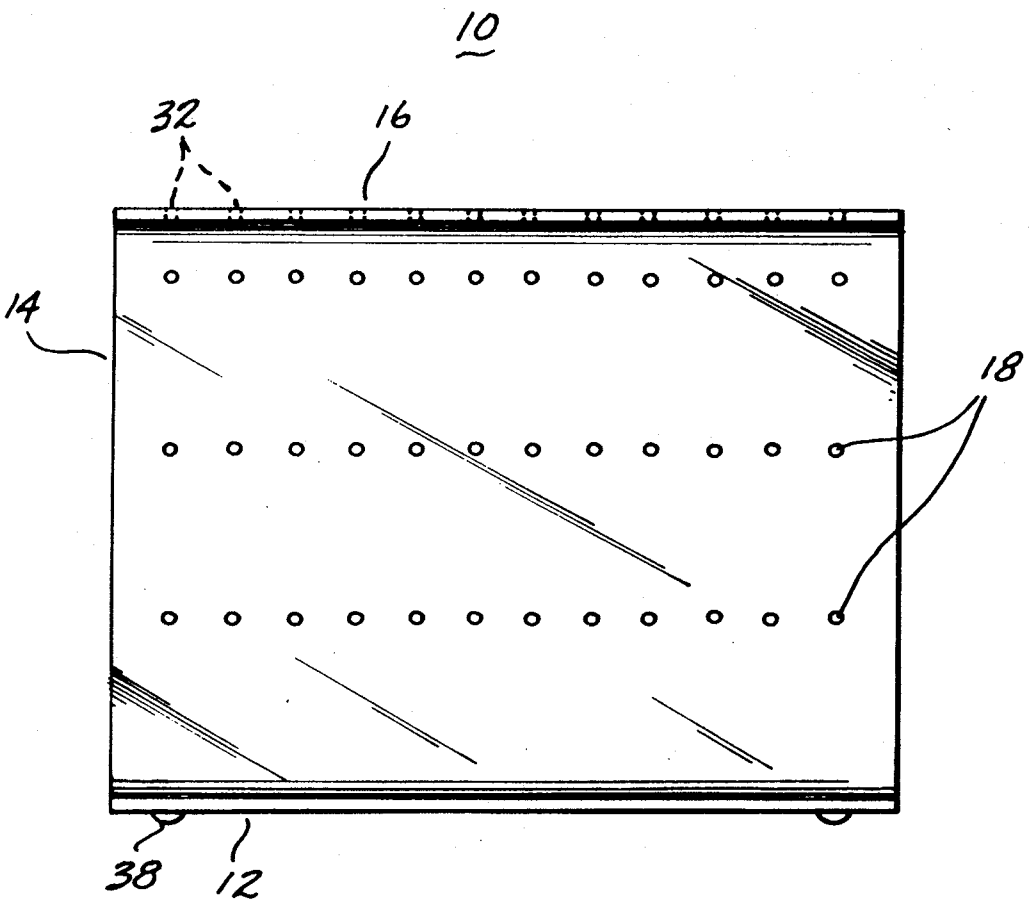
FIG. 4 is a rear elevational view of the earring stand shown in FIG. 1.

Referring to the FIGURES, an earring stand or holder 10 constructed according to a preferred embodiment of the present invention consists of a base panel 12, a front panel 14, and a top panel 16. In the preferred embodiment, the base panel 12, the front panel 14 and the top panel 16 are all formed a single rectangular sheet of transparent or semi-transparent material, for instance, a plastic material such as plexiglass, which is bent twice parallel to one of its edges to form the flat three panels.

As shown in the FIGURES, a plurality of paired holes 18 are formed in horizontal rows across the front panels for holding pierced earrings. For demonstrative purposes, a pierced earring 20 is shown in FIG. 1 and includes a stud 22, a post 24, and a back 26. The holes 18 in the front panel 14 are sized so that the post 24 of the pierced earring 20 may pass through the holes without allowing the stud 22 of the pierced earring passing through the holes. The minimum diameter of such holes is determined by the diameter of the largest post generally used on pierced earrings, approximately 1/16 inch. Likewise, the maximum diameter of such holes is determined by the diameter of the smallest stud generally found on pierced earrings, approximately ⅛ inch. Holes of this size also will prevent the backs 26 of the earrings from passing through the holes so that the earrings do not detach from the stand if the holder 40 is accidentally tipped over or dropped.

Although the base panel 12 is illustrated in the FIGURES as being rectangular in shape and as being formed from the same sheet of material as the front panel 14, there is no inherent limitation in the present invention regarding the composition or shape of the base panel. The base panel may be opaque or even non-transparent, and may have any shape or size so long as it supports the front panel in upright orientation when the base panel is placed on a horizontal surface.

The front panel 14 is illustrated as having a substantially straight bottom edge portion. The front panel 14 is attached to the base panel 17 by joining the front edge of the base panel to the bottom edge of the front panel to form a corner joint 28. In a preferred embodiment, the corner joint 28 is formed by a bend between the base panel 12 and the front panel 14.

Figure 3:
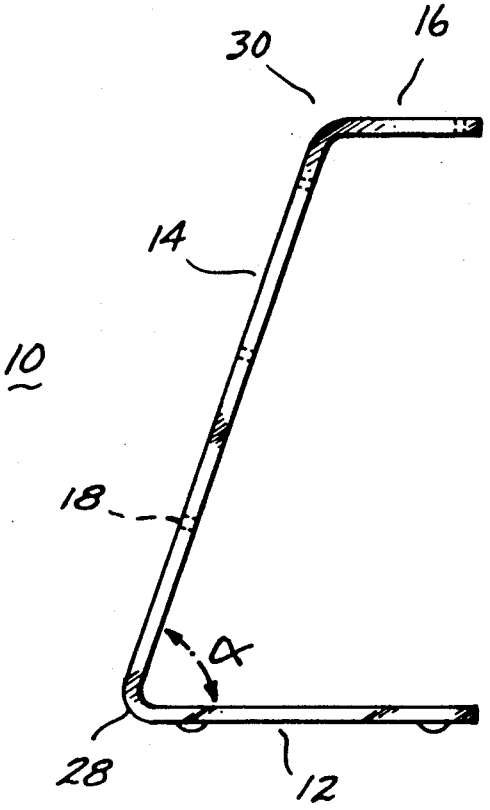
FIG. 3 is a side elevational view of the earring stand shown in FIG. 1.
Figure 5:
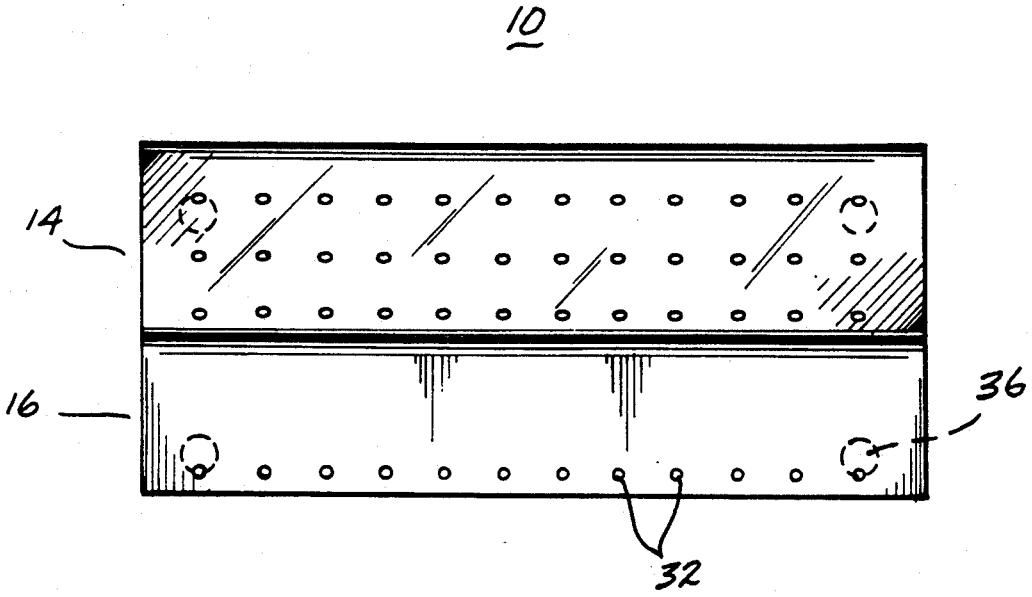
FIG. 5 is a top plan view of the earring stand shown in FIG. 1.
Figure 6:
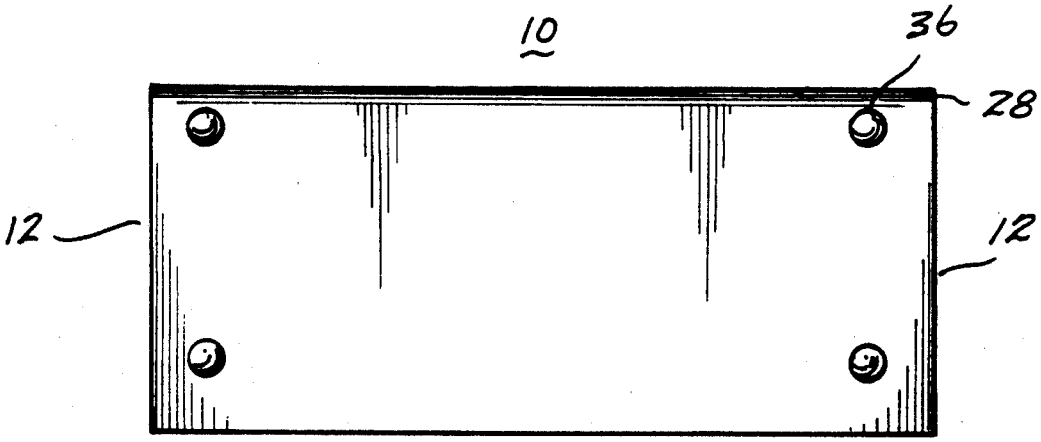
FIG. 6 is a bottom view of the earring stand shown in FIG. 1.

The base panel 12 and the front panel 14 are joined so that the base panel and the front panel form an acute angle $\alpha$ as shown in FIG. 3. In the embodiment shown in FIG. 3, the acute angle $\alpha$ is approximately 70 degrees. However, as will be discussed later in this specification, a wide range of acute angles is encompassed in the present invention. Forming the angle $\alpha$ as an acute angle causes the front panel to slope rearwardly in the upward direction, as shown in FIGS. 1 and 3. As a result, the weight of the earrings mounted on the front panel will be centered over the base panel 12 to lend stability to the stand.

Since earrings are frequently sold in pairs, the holes 18 in the front panel are preferably formed in pairs to keep the earring of a pair together. Although the holes 18 in the preferred embodiment are arranged in horizontal rows, the present invention is not limited to any particular arrangement of paired holes. In the preferred embodiment, the horizontal rows are separated by approximately 1½ inches to allow for larger, dangling earrings to hang below the holes. Of course, a different spacing may be used between adjacent rows depending on various factors, including the types and sizes of earrings to be stored. The holes in each horizontal row are spaced ideally approximately ½ inch apart. Spacing of the holes less than ¼ inch apart may make it difficult to easily remove a particular earring. Likewise, spacing the holes more than 1 inch apart may unnecessarily reduce the number of earrings the stand may hold.

Ideally the material composing the front panel 14 is transparent or at least semi-transparent. More specifically, it is highly desirable to be able to see the location of earring backs through the front panel so the earring back can be easily attached to the earring post when the post is in one of the holes in the front panel. The front panel may be colored, or semi-transparent, as long as this condition is met. Likewise, the front panel should be sufficiently thin to allow the back of the pierced earring to be attached to the post of the pierced earring when the post is inserted in one of the holes in front panel. Forming the front panel 14, in a thickness of about ⅛ inch, should allow the back of the pierced earring to be easily engaged over its mating post.

The top panel 16 in the preferred embodiment shown in the FIGURES is joined to the top edge portion of the front panel 14 at a corner joint 30. In a preferred embodiment, the corner joint 30 is formed by a bend between the top panel and the front panel, so that top panel is generally parallel to the base panel.

A plurality of holes 32 are provided in the top panel for holding pierced earrings. Ideally the holes 32 are sized similar to the holes 18 in the front panel and are in a row located fairly closely to the back edge of the top panel (perhaps from ¼ to ½ inch), so that pierced loop earrings may be easily inserted in the holes. The holes 32 are spaced ideally approximately ½ inch apart for the same reasons as the spacing of the holes on the front panel. As shown in FIG. 1, the earrings carried by the top panel 16 may be engaged upwardly from the bottom so that they hang down beneath the top panel. This allows long earrings to be stored in suspended fashion rather than lying in a pile in a typical jewelry box. A loop type earring 34 is shown in FIG. 1, with the loop portion 36 of the earring extending through a hole 32. Longer earrings utilizing a post can also be engaged upwardly through the holes 32, with the back positioned on top of the panel 16. It will be appreciated that the holes 32 formed in the top panel are small enough to prevent the backs of the earrings from falling downwardly therethrough.

In order to restrain the stand from sliding, a non-skid surface may be provided on the bottom of the base panel 12. In the preferred embodiment, this non-skid surface consists of a hemispherical pad 38, of soft, resilient, skid resistant material, for example, latex, located near each of the four corners of the base panel.

Figure 7:
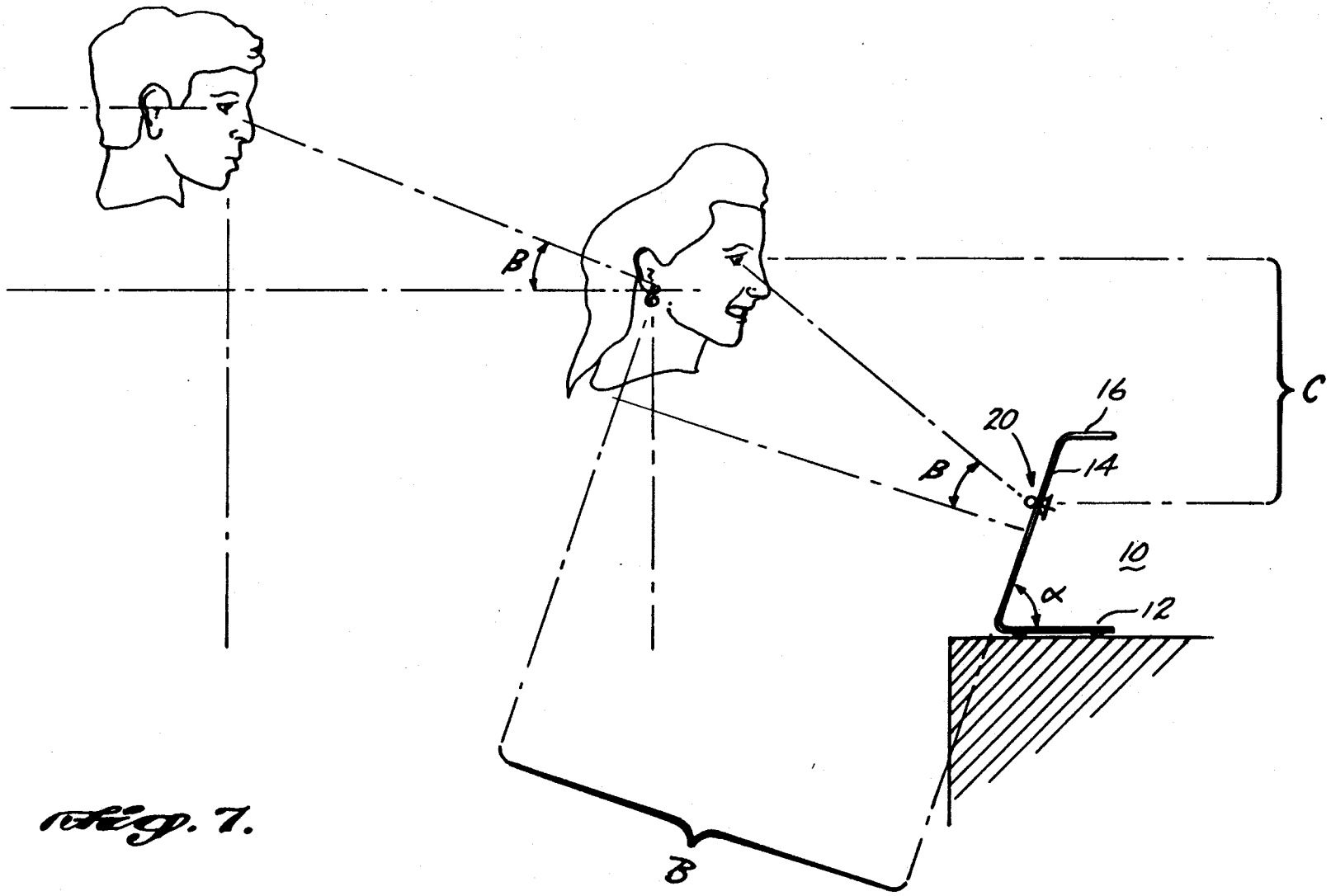
FIG. 7 is a side elevational view of the earring stand shown in FIG. 1 as viewed by a user.

Referring specifically to FIG. 7, in selecting a pair of earrings, the user of the earring stand presumably is interested in how the earrings will appear to other people when the earrings are worn by the user. As part of this process, the user may attempt to envision how the earrings will appear when viewed by other people from a particular angle $\beta$, while the user is wearing the earrings. The angle $\beta$ is referred to in the following discussion as the presentation angle $\beta$.

The user will observe the earrings on the front panel of the stand from a particular vertical angle, determined by (a) the distance between the user and the stand; (b) the vertical distance between of the stand and eye level of the user; and (c) the angle $\alpha$ between the base panel and the front panel. For a given distance from the stand and vertical distance between the user and the stand, the angle between the base panel and the front panel can be selected so that the earrings on the front panel will be viewed from the presentation angle $\beta$, For example, if the earring stand is placed on a relatively low dresser or table, and viewed from a distance of 24 inches and a vertical distance of 30 inches, the angle $\alpha$ between the base panel and front panel necessary to obtain a 10 degree presentation angle is:

$$\alpha = \arctan\left(\frac{24}{30}\right) + 10^\circ = 49^\circ \tag{1}$$

Likewise, if the stand is placed on a relatively high dresser or table, and viewed from a distance of 24 inches and a vertical distance of 6 inches, the angle between the base panel and front panel for a 10 degree presentation angle is:

$$\alpha = \arctan\left(\frac{24}{6}\right) + 10^\circ = 86^\circ \tag{2}$$

Due to the method of manufacturing the earring stand of the present invention, the angle between the front panel and the base panel can readily be varied over a large range from one earring stand to the next. As a result, stands having different angles between the base panel and the front panel can be readily produced. This allows the user to select from a range of stands depending upon the applicable presentation angle, vertical distance and distance from the stand.

One of ordinary skill after reading the foregoing specification may be able to affect various other changes, alterations and substitutions of equivalence without departing from the concepts disclosed. It is therefore intended that the scope of the Letters Patent rendered herein be limited only by the definitions contained in the appended claims and the equivalence thereof.

The embodiments of the invention in which an exclusive property or privilege is claimed are defined as follows:

1. A stand for holding pierced earrings which have a stud, a post, and a removable back, comprising:

a front panel having a plurality of paired holes sized for insertion of the post of a pierced earring without allowing the stud of a pierced earring to pass through the hole, a top edge portion, and a bottom edge portion, and being sufficiently thin to allow the back of a pierced earring to be attached to the post of a pierced earring while the post is in a hole;

a base panel having a front edge portion which is joined to the bottom edge portion of the front panel so that the base panel and front panel are joined at an acute angle;

a top panel having a front edge portion joined to the top edge portion of the front panel, and having a plurality of paired holes sized for insertion of the post of a pierced earring without allowing the stud of a pierced earring to pass through the hole; and wherein the top panel, front panel, and base panel are formed from one sheet of material, and the holes in the front panel and top panel are between 1/16 inch and ⅛ inch in diameter.

2. The earring stand of claim 1, wherein:

the acute angle between the front panel and the base panel is approximately 70 degrees; and the base panel and the top panel are substantially parallel.

3. The earring stand of claim 2, further comprising a non-skid surface on the underside of the base panel.

4. A method for making an earring stand, comprising the following steps:

bending a transparent sheet of material to form a front panel and a base panel with an acute angle between the base panel and the front panel; and creating a plurality of paired holes in the front panel with the holes sized for insertion of the posts of pierced earrings without allowing the studs of the pierced earrings to pass through the holes;

bending the sheet of transparent material a second time to form a top panel substantially parallel to the base panel; and creating a plurality of paired holes in the top panel with the holes sized for insertion of the posts of pierced earrings without allowing the studs of the pierced earrings to pass through the holes.

5. The earring stand made by the method of claim 4.

6. A stand for holding pierced earrings which have a stud, a post and a removable back, comprising:

a transparent sheet of material which is bent at an acute angle to form a front panel and a base panel and is bent to form a top panel substantially parallel to the base panel; and wherein the front panel and top panel have a plurality of paired holes sized for insertion of the posts of pierced earrings without allowing the studs of the pierced earrings to pass through the holes.

* * * * *